United States Patent [19]

Slaghuis et al.

[11] Patent Number: 4,565,332

[45] Date of Patent: Jan. 21, 1986

[54] METHOD AND DEVICE FOR AVOIDING THE FORMATION OF RIBBON WINDINGS WHEN WINDING CHEESES

[75] Inventors: Hermann Slaghuis; Rolf Mayer, both of Monchen-Gladbach; Heribert Kargel, Viersen; Heinz G. Bender, Monchen-Gladbach, all of Fed. Rep. of Germany

[73] Assignee: Schlafhorst & Co., Monchen-Gladbach, Fed. Rep. of Germany

[21] Appl. No.: 633,133

[22] Filed: Jul. 20, 1984

[30] Foreign Application Priority Data

Jul. 21, 1983 [DE] Fed. Rep. of Germany ..... 3326217

[51] Int. Cl.[4] ..... B65H 54/38

[52] U.S. Cl. ..... 242/18.1

[58] Field of Search ..... 242/18.1, 18 DD

[56] References Cited

U.S. PATENT DOCUMENTS 1,930,106 10/1933 McKean ..... 242/18.1

1,955,778 4/1934 Swanson ..... 242/18.1

FOREIGN PATENT DOCUMENTS 897882 5/1962 United Kingdom ..... 242/18.1

*Primary Examiner*—Stanley N. Gilreath

*Attorney, Agent, or Firm*—Herbert L. Lerner; Laurence A. Greenberg

[57] ABSTRACT

Method of avoiding a formation of ribbon windings when winding a frictionally driven crosswound coil with a wild winding, which includes braking an element rotatingly connected with the crosswound coil with a varying braking force.

10 Claims, 3 Drawing Figures

METHOD AND DEVICE FOR AVOIDING THE FORMATION OF RIBBON WINDINGS WHEN WINDING CHEESES

The invention relates to a method and a device for avoiding the formation of ribbon windings when winding, with a wild or irregular winding, of cross-wound coils or cheeses driven by friction.

Such methods and devices have the purpose of avoiding formation of ribbon windings i.e. windings which are disposed tightly against or above one another, which are produced from time to time during the winding operation on the coil periphery, espcially within given diameter ranges.

It has become known heretofore to provide for this purpose a friction drive for the crosswound coil, with a drive cylinder or drum which is brought into a time-limited driving connection with a drive shaft via a periodically swung-in friction roller.

After an interruption of the drive has occurred, when the friction roller has swung in again, slippage takes place between the crosswound coil and the drive cylinder, due to which a ribbon winding which has formed is to be disrupted and loosened or unraveled.

The aforementioned measures do not, however, completely avoid the formation of such ribbon windings. Over relatively long time periods, the crosswound coil rotates at the same peripheral speed as that of the drive cylinder or drum. Even if the thread guide moves in synchronism with the revolutions of the crosswound coil, ribbon windings of limited extent are formed nevertheless. Although these ribbon windings can be kept small, they are nevertheless disturbing later on when the yarn is withdrawn upwardly overhead from the cross-wound bobbins.

It is accordingly an object of the invention to provide a method and device for avoiding the formation of ribbon windings when winding a frictionally driven crosswound coil with a wild winding, which avoid the disadvantages of the heretofore known methods and devices of this general type, and which reliably prevent both the systematic as well as the occasional occurrence of ribbon windings without great expense.

With the foregoing and other objects in view, there is provided, in accordance with the invention a method of avoiding a formation of ribbon windings when winding a frictionally driven crosswound coil with a wild winding, which comprises braking an element rotatingly connected with the crosswound coil with a varying braking force. Such rotating elements are, for example, coil core or coil tube clamping devices or coil tube carriers. The effect of this measure is a continuously varying delayed or retarded entrainment of the crosswound coil with respect to the drive thereof which, in general, is caused by an uniform motion. Synchronism between the thread guidance rhythm and the rate of revolution of the crosswound coil cannot exist for such long periods of time as to permit the formation of ribbon windings of disturbing size.

In accordance with another mode of the method invention, the method includes driving the crosswound coil by a drive cylinder having reverse winding grooves formed therein for guiding a thread, and adjusting and varying the braking force so that slippage of continously varying extent occurs between the crosswound coil and the drive cylinder.

Because it is easier to brake a coil with a smaller mass than a coil with a greater mass, in accordance with a further mode, the method invention includes increasing the braking force with increasing mass of the crosswound coil.

Because the rhythm or cycle for disrupting the formation of the ribbon windings may itself again cause the formation of the ribbon windings though of smaller size, in accordance with an additional mode, the method of the invention includes controlling the braking force so as to avoid synchronism between thread guidance rhythm in the drive cylinder and rate of rotation of the crosswound coil. In this connection, in accordance with an added mode, the method of the invention, includes controlling the braking force so as to keep a reduction in rotational speed of the crosswound coil within a fluctuating range of substantially 15%. For greater fluctuating ranges, the reliability of the thread guiding arrangement is reduced.

In accordance with another aspect of the invention, there is provided device for performing a method of avoiding a formation of ribbon windings when winding a frictionally driven crosswound coil with a wild winding, comprising a rotating element connectible with the crosswound coil, and a brake engageable with the rotating element, the brake being operatively connected with a controllable braking force adjusting device having means for supplying continuously varying braking forces. The braking force adjusting device may be formed of different braking force generators. For example, eccentrics, oscillating pistons or the like are applicable as braking force generators. Also, oscillating motor drives or electromagnetic actuators are usable as braking force generators.

More particularly, in accordance with another feature of the invention the means for supplying continuously varying braking forces comprise a rotating braking force generator scannable by means for transmitting the braking force generated thereby. For example, the braking force generator can be a cam, and the braking force transmission means can be an element sensing or scanning this cam, such as, a follower roller, for example.

In accordance with a further feature of the invention, the braking force generator has a surrounding control surface closed upon itself. For this purpose especially, a rotating spatial form is visualized having an outer surface which can be sensed or scanned. For example, an eccentrically supported rotating cylinder, a body with polygonal surfaces, or a body with a surrounding surface having rises and depressions formed therein can be used.

In order to be able to increase the braking force with increasing fullness of the crosswound coil or bobbin, in accordance with a further feature of the invention, the braking force generator is mounted on a rotary shaft and is of pyramidal construction, the braking force generator being slidable along said rotary shaft yet fixed against relative rotation therewith. During the travel or increase in fullness of the coil, the pyramidal braking force generator can be shifted axially so that the scanning or sensing element is increasingly deflected farther from the rotational axis of the braking force generator, resulting in an increase in the braking force.

In order to effect automatically an increase in the braking force as the crosswound coil grows in size or fullness, in accordance with an added feature of the invention, the rotating a stroke position of the coil frame, the shifting device being operatively connected with the coil frame. Accordingly, the crosswound coil frame, which lifts itself away from the winding or drive cylinder or drum as the crosswound coil grows in size or fullness, displaces the braking force generator, with the objective of increasing the braking force.

Alternatively thereto, in accordance with yet another feature of the invention, the device includes a drive cylinder for frictionally driving the crosswound coil, and includes means for controlling the braking force adjusting device in accordance with a difference between respective rates of revolution of the drive cylinder and of the crosswound coil. For this purpose, it is necessary to monitor and determine the number of revolutions or rate of rotation of the drive cylinder or drum and of the crosswound coil or cheese. In some cases the number of revolutions of the drive cylinder is known, and in some cases it is a constant. The number or rotations or rotary speed of the crosswound coil can be either directly measured, or deduced from the deflection of the crosswound coil frame.

In accordance with a concomitant feature of the invention, respective revolution counters are operatively connected with the drive cylinder and with the rotating element connectible with the crosswound coil, and an electronic control device is conncted with the revolution counters and operatively connected with the braking force adjusting device or the braking force generator thereof. The electronic control device compares the numbers of revolution or rotary speeds with one another, and ensures, for example, that the reduction in rotary speed of the crosswound coil remains within a range of approximately 15%. If the rotary speed or number of revolutions approaches an upper limit, the braking force is increased to such an extent that the lower limit is not passed, whereupon the braking force is again decreased, and so forth.

Other features which are considered as characteristic for the invention are set forth in the appended claims.

Although the invention is illustrated and described herein as embodied in a method and device for avoiding the formation of ribbon windings when winding cheeses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
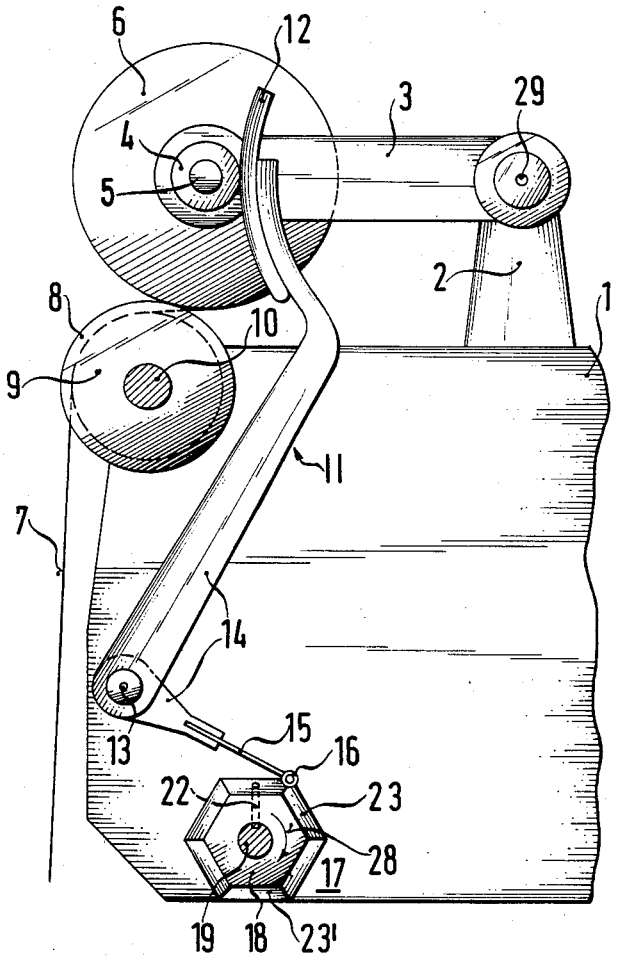
FIG. 1 is a fragmentary diagrammatic side elevational view of a winding machine constructed in accordance with the invention.

Referring now to the drawing and first, particularly, to FIG. 1 thereof, there is shown a winding machine 1 having an arm 2 which carries a swingable coil or bobbin frame 3. A rotatable element or coil carrier 4 which clamps and carries a coil core or tube 5 of a crosswound coil or cheese 6 is mounted in the coil frame 3.

A drive cylinder or drum 9 formed with reverse winding grooves 8 is employed for driving the cheese 6 and for guiding a thread 7 which is to be wound. The drum 9 is mounted on a shaft 10 which continuously rotates during the winding operation.

Because the cheese 6 rolls on the drive drum 9, and is driven by frictional engagement with this drive drum 9, the element 4 which is connected to the cheese 6 also rotates therewith. The element 4 is in contact with a brake 11, which has a brake shoe 12 fastened to an angular lever 14 which is pivotable about a pivot point 13. An operative connection between the brake 11 and a controllable braking force adjusting device 17 is provided by means of a braking force transmission system formed of a leaf-spring 15 and a roller 16, the braking force adjusting device 17 supplying continuously varying braking forces. The braking force adjusting device 17 has a rotating braking force generator 18 which is mounted on a driven shaft 19 so as to be slidable along the rotational axis thereof but fixed against rotation relative thereto. For this purpose, an elongated groove 20 FIG. 2 is machined into the shaft 19, and a guide key 22 connected to the braking force generator 18 engages in the groove 20.

The braking force generator 18 is of pyramidal construction, and has, at the periphery thereof, six polygonally arranged surfaces 23' which together form a control surface 23 which is closed on itself.

Figure 2:
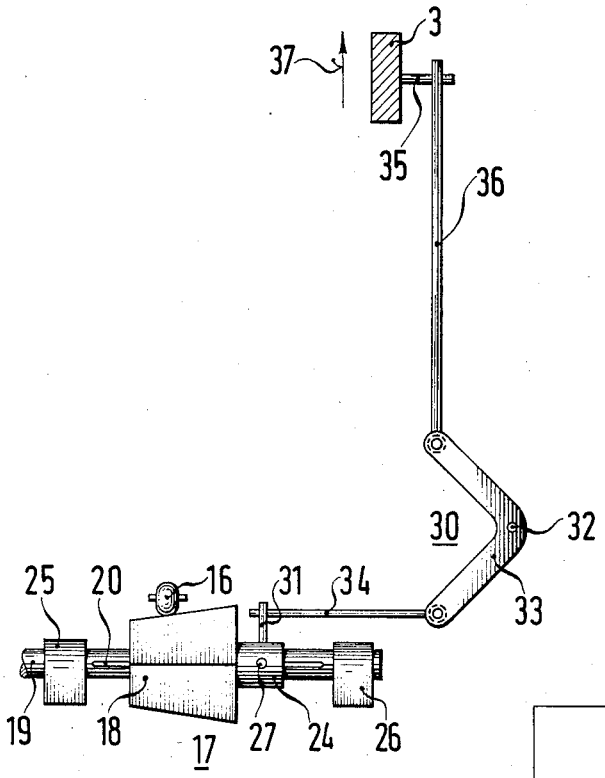
FIG. 2 is a fragmentary front elevational view, partly in section, of FIG. 1, showing parts of a brake transmission of the winding machine.

FIG. 2 shows that a sliding collar 24 is rotatably mounted on the braking force generator 18. The sliding collar 24 is also supported on the shaft 19, and is slidably mounted on this shaft 19 which, for its part, is supported in the bearings 25 and 26.

FIG. 1 illustrates the simplest operating condition. The braking force generator 18, in this operating condition, is fixed in position on the shaft 19, for example, by tightening a set screw 27 shown in FIG. 2. Beforehand, the required brake pressure was adjusted by sliding the braking force generator 18 on shaft 19. The instant the shaft 19 then rotates in direction of the arrow 28, varying forces are transmitted to the brake shoe 12 via the braking force transmission system 15, 16. The brake shoe 12 is of arcuate construction and is oriented at a pivot point 29 of the bobbin or coil frame 3. In this manner, assurance is provided that the desired braking force will be applied in each winding condition of the cheese 6. If the braking force is supposed to be increased with increasing spool diameter, this can be achieved by disposing the upper end of the brake shoe 12 somewhat farther away from the pivot point 29 than the lower end.

In the modified embodiment according to FIG. 2, the braking force generator 18 is provided with a shifting device 30 actionable to set the position of the braking force generator 18 according to the stroke position of the bobbin frame 3 which carries the cheese 6. The shifting device 30 is made up of the aforementioned sliding collar 24, an entrainer 31 fastened to the slide collar 24, an angular lever or bellcrank 33 pivotable about the pivot point 32, and a rod 34 articulatingly connecting the angular lever 33 to the entrainer 31.

The bobbin frame 3 is also provided with an entrainer 35 from which an articulating control connection with the angular lever 33, and thereby also with the shifting device 30 is effected via a control rod 36.

During the coil travel i.e. during formation or winding of the cheese 6, the bobbin frame 3 swings slowly upwardly in direction of the arrow 37. As viewed in FIG. 2, the angular lever 33 thereby swings clockwise and slides the sliding collar 24 towards the left-hand side 1 the set screw 27 having been loosened. Together with the slide collar 24, the braking force generator 18 is shifted towards the left-hand side, so that the roller 16 must travel upwardly on the control surface 23. This results in an increase of the braking force.

Figure 3:
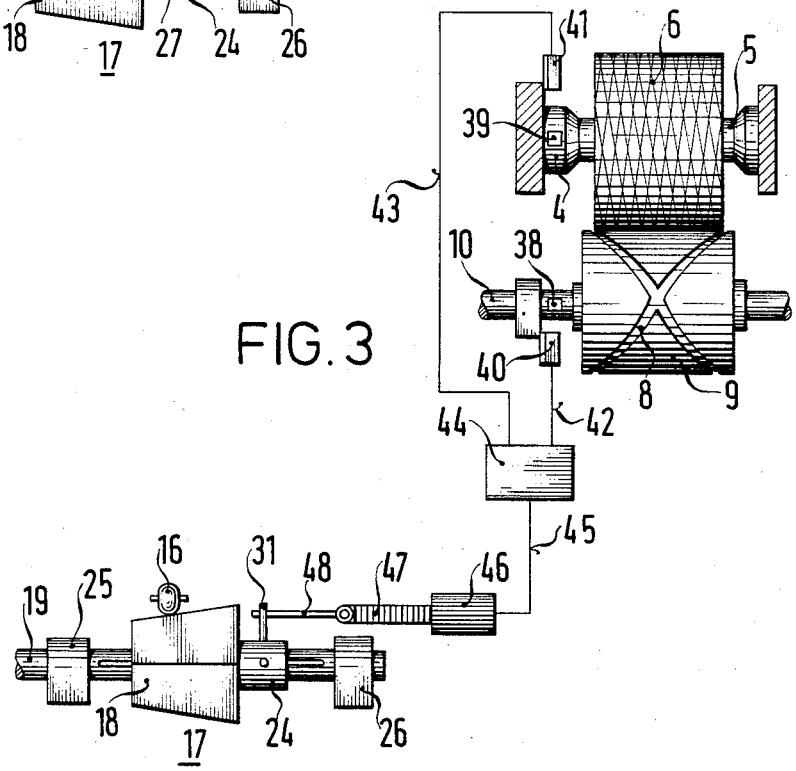
FIG. 3 is a view similar to that of FIG. 2 of an alternate embodiment of the brake transmission.

Another possible embodiment for controlling the braking force is diagrammatically indicated in FIG. 3.

In the embodiment of FIG. 3, the braking force generator 18 is controllable according to the difference between the number of revolutions of the drive drum 9 and of the cheese 6.

To achieve this, an operative connection is provided between the drive cylinder 9 and a revolution counter 40 by means of an index mark 38 applied to the shaft 10, and an operative connection between the rotating element 4 connected to the cheese holder 6 and another revolution counter 41 is provided by means of an additional index mark 39. The revolution counter 40 is connected by a line 42, and the revolution counter 41 by a line 43, to an electronic control device 44.

In turn, the electronic control device 44 is operatively connected to the braking force adjusting device 17. This operative connection is formed as follows: via an electric line 45, the electronic control device 44 controls a transmission or gear motor 46, which is capable of displacing a toothed rack 47. The toothed rack 47 is articulatingly connected with the entrainer element 31 of the sliding collar 24 by means of a shifter rod 48.

In the electronic control device 44, which is of conventional construction, the measured number of revolutions are continuously compared with one another. By controlling the drive motor 46, the control device 44 then ensures that there is always a sufficiently large latitude in the fluctuation or variation of the rotational speed reduction of the cheese. In practice, provisions are made to keep the reduction of rotational speed within a fluctuation range of about 15%. This is effected by suitable adjustment of the braking force.

As mentioned hereinbefore, the invention should not be limited to the illustrated and hereinafore-described specific embodiments which were used by way of examples.

We claim:

1. Method of avoiding a formation of ribbon windings when winding a frictionally driven crosswound coil with a wild winding, which comprises directly applying a braking force to an element rotatingly connected with the crosswound coil and secured thereto against relative rotation therewith, increasing the braking force with increasing mass of the crosswound coil, and controlling the braking force so as to avoid synchronism between thread guidance rhythm in the drive cylinder and rate of rotation of the crosswound coil.

2. Method according to claim 1 which includes driving the crosswound coil by a drive cylinder having reverse winding grooves formed therein for guiding a thread, and adjusting and varying the braking force applied to the element so that slippage of continuously varying extent occurs between the crosswound coil and the drive cylinder.

3. Method according to claim 1 which includes controlling the braking force so as to keep a reduction in rotational speed of the crosswound coil within a fluctuating range of substantially 15%.

4. Device for avoiding a formation of ribbon windings when winding a frictionally driven crosswound coil with a wild winding, comprising a rotating element connectible with the crosswound coil, a brake engageable with said rotating element, said brake being operatively connected with a controllable braking force adjusting device having means for supplying continously varying braking forces which increase with increasing mass of the crosswound coils, a drive cylinder for frictionally driving the crosswound coil, and means for controlling said braking force adjusting device in accordance with a difference between respective rates of revolution of the drive cylinder and of the crosswound coil so as to avoid synchronism between thread guidance rhythm in said drive cylinder and rate of rotation of the crosswound coil.

5. Device according to claim 4 wherein said means for supplying continuously varying braking forces comprise a rotating braking force generator and means operatively engaging in said braking force generator for transmitting the braking force generated thereby.

6. Device according to claim 5 wherein said braking force generator has a peripheral control surface closed upon itself.

7. Device according to claim 5 wherein said braking force generator is mounted on a rotary shaft and is of pyramidal construction, said braking force generator being slidable along said rotary shaft yet fixed against relative rotation therewith.

8. Device according to claim 7 wherein said rotating element is mounted in a coil frame swingable through varying positions in accordance with the increasing mass of the crosswound coil, and said braking force generator has a shifting device actionable for setting said braking force generator into a position corresponding to one of said positions of said coil frame, said shifting device being operatively connected with said coil frame.

9. Device according to claim 4 including respective revolution counters operatively connected with the drive cylinder and with said rotating element connectible with the crosswound coil, and an electronic control device connected with said revolution counters and operatively connected with said braking force adjusting device.

10. Device according to claim 9 wherein said electronic control device is operatively connected with said braking force generator of said braking force adjusting device.

* * * * *